US007232050B2

(12) United States Patent
Omli

(10) Patent No.: US 7,232,050 B2
(45) Date of Patent: Jun. 19, 2007

(54) MANUALLY ACTUATED FASTENER DRIVER WITH FASTENER CAP RESERVOIR AND ADVANCEMENT MECHANISM

(75) Inventor: Allan T. Omli, Winston-Salem, NC (US)

(73) Assignee: Allan Omli, LLC, Winston-Salem, NC (US)

( * ) Notice: Subject to any disclaimer, the term of this patent is extended or adjusted under 35 U.S.C. 154(b) by 0 days.

(21) Appl. No.: 11/061,933

(22) Filed: Feb. 21, 2005

(65) Prior Publication Data

US 2006/0186167 A1 Aug. 24, 2006

(51) Int. Cl.
*A41H 37/00* (2006.01)
*A41H 37/06* (2006.01)
*A41H 37/04* (2006.01)

(52) U.S. Cl. ..... 227/31; 227/15; 227/18

(58) Field of Classification Search ..... 227/15, 227/16, 18, 31, 119, 120, 133, 147, 146; 221/232

See application file for complete search history.

(56) References Cited

U.S. PATENT DOCUMENTS 2,432,853 A 6/1947 Barclay
2,653,317 A * 9/1953 Beckman et al. ..... 227/86
2,661,999 A 12/1953 Abrams
2,680,393 A 6/1954 Howell
2,896,210 A 7/1959 Rubin
3,353,737 A 11/1967 Howard et al.
3,707,406 A 12/1972 Perkins
3,854,648 A 12/1974 Inzoli et al.
3,966,042 A 6/1976 Shelton et al.
3,991,325 A 11/1976 Buchel
4,033,499 A 7/1977 Butler
4,182,474 A 1/1980 Sato
4,535,925 A 8/1985 Ramey et al.
4,657,167 A 4/1987 Mays
4,923,099 A 5/1990 Hasegawa et al.
4,932,580 A 6/1990 Pfister et al.
4,998,662 A 3/1991 Hasan et al.
5,042,142 A 8/1991 Beach
5,056,684 A 10/1991 Beach et al.
5,069,340 A 12/1991 Ernst et al.
5,090,607 A 2/1992 Ohuchi et al.
5,184,752 A * 2/1993 Zylka et al. ..... 221/1
5,193,729 A 3/1993 Dewey et al.
5,267,682 A 12/1993 Okouchi
5,292,048 A 3/1994 Vanderwiel
5,327,645 A 7/1994 Bromley et al.
5,339,983 A * 8/1994 Caple ..... 221/25
5,365,709 A 11/1994 Lassiter
5,402,695 A 4/1995 Hornung
5,484,094 A 1/1996 Gupta
5,547,325 A 8/1996 Tucker et al.
5,579,975 A 12/1996 Moorman
5,649,661 A 7/1997 Masuno et al.
5,884,829 A 3/1999 Wingert (Continued)

*Primary Examiner*—Sameh H. Tawfik
*Assistant Examiner*—Nathaniel Chukwurah
(74) *Attorney, Agent, or Firm*—Womble Carlyle Sandridge & Rice, PLLC

(57) ABSTRACT

The invention provides a manually actuated fastener driver device having a fastener cap reservoir disposed in proximity to the driver of the device and a cap advancement mechanism. Upon each actuation, the device delivers a cap and fastener to a work surface, for example, during the attachment of a sheet-like material to the work surface.

16 Claims, 8 Drawing Sheets

U.S. PATENT DOCUMENTS 5,934,504 A 8/1999 Elliott
5,947,362 A 9/1999 Omli
5,975,401 A 11/1999 Lu
6,012,623 A 1/2000 Fealey
6,027,004 A * 2/2000 Ramella et al. ..... 227/136
6,145,725 A 11/2000 Omli
6,550,660 B1 4/2003 Chlebowski
6,779,700 B2 8/2004 Bruins et al.
6,802,443 B2 10/2004 Lu
6,966,389 B1 11/2005 Riggs
2003/0015565 A1* 1/2003 Lee ..... 227/18

* cited by examiner

At Rest

Full Stroke

MANUALLY ACTUATED FASTENER DRIVER WITH FASTENER CAP RESERVOIR AND ADVANCEMENT MECHANISM

FIELD OF THE INVENTION

The invention relates to a manually actuated, hammer-type fastener driver, having a fastener cap reservoir and advancement mechanism for selectively delivering a capped fastener upon actuation of the device.

BACKGROUND

Fasteners are often used in conjunction with caps, often plastic, when securing sheet-like materials such as roofing felt or plastic building wrap. Caps, such as plastic discs, often are circular or oval and somewhat concave on the side contacting the sheet-like material, may be used with staples or nails driven manually as with a conventional hammer, or via some type of staple or nail gun. Staple or nail guns may be powered by electricity or air pressure, or may operate using a manually applied force. The manually applied force can be the force of a striking action, such as with so-called "slaphammers" as are known in the art.

In the simplest application, caps may be placed beneath a fastener prior to manually driving a manually-placed fastener through the cap to secure sheet-like materials. One advance over this simplest method has been to supply fasteners, e.g. nails, with the fastener already inserted through a cap piece. Further, systems have been developed for feeding caps from a reservoir or magazine into position in a power-driven apparatus, such that the fasteners are driven through the automatically positioned caps upon activation of the device. See, for example, U.S. Pat. Nos. 6,145,725 and 5,947,362 to Omli, the disclosures of which are hereby fully incorporated herein by reference.

Although some systems include a supply of caps that purport to feed into position in a manually actuated fastener driver, many limitations are characteristic of current devices. Accordingly, a need persists for a manually actuated fastener driver having a reservoir of caps and which automatically positions such caps for co-application with a fastener.

SUMMARY

The invention provides a manually actuated fastener driver device comprising a cap magazine configured to hold caps and a mechanism to feed such caps into position beneath a fastener each time the driver is actuated. The driver can be manually actuated by striking the driver device against a surface receiving the fastener, like the operation of a conventional slaphammer. The caps can be configured in a linear assembly, connected by one or more breakable members or a carrying strip of frangible material, such that they may be present in a rolled configuration in the magazine and advanced to a position beneath a fastener while still connected by the breakable members.

Accordingly, in one aspect, the invention relates to a manually actuated fastener driver device comprising a fastener driver frame having a reservoir of fasteners that feed into position beneath a driver operated by a driver lever that is actuated via a force applied manually by a user; a fastener cap reservoir disposed in proximity to the driver of the device and configured to contain a supply of fastener caps arranged in a cap strip having a connection between individual caps that is breakable upon actuation of the device and delivery of an individual cap; a cap track providing guidance for the cap strip from the reservoir to a position proximal to a fastener delivery position such that a fastener can be delivered through an individual cap upon actuation of the device; and a cap advancement mechanism configured to advance the cap strip one cap position upon each actuation of the device. The cap advancement mechanism is driven by manual actuation of the device.

In another aspect, the invention relates to a manually actuated fastener driver device comprising a fastener driver frame having a reservoir of fasteners that feed into position beneath a driver operated by a driver lever that is actuated via contact with a first end of a striker lever, the striker lever receiving a force from a striker past an intermediate fixed pivotal attachment point, wherein the force is provided by contact with a work surface when a user strikes the work surface with the striker of the device; a fastener cap reservoir disposed in proximity to the driver of the device and configured to contain a supply of fastener caps arranged in a cap strip, and where the cap strip includes a connection between individual caps in the strip that is breakable upon actuation of the device and delivery of a cap and fastener; a cap track providing guidance for the cap strip from the reservoir to a position in proximity to a location beneath a fastener and such that a fastener is delivered through an individual cap upon actuation of the device; and a cap advancement mechanism configured to advance the cap strip one cap position upon each actuation of the device. The cap advancement mechanism comprises a cap advance slider in a cap advance slider guide, contacted by a second end of the striker lever configured to contact a cap advance slider striker lever catch; a cap advance slider spring, attached to the cap advance slider and a fixed point on the fastener driver frame; a cap pusher pivotally connected to the cap advance slider that contacts the cap strip to advance the cap strip upon actuation of the device. The cap advance slider is advanced in the cap advance slider guide against the force of a cap advance slider return spring by contact with a second end of the striker lever configured to contact a cap advance slider upon actuation, and where the cap pusher advances the cap strip as the cap advance slider is returned to a pre-actuation position under force of the cap advance slider return spring.

These and other aspects of the present invention as disclosed herein will become apparent to those skilled in the art after a reading of the following description of the preferred embodiments when considered with the drawings.

DETAILED DESCRIPTION

Figure 1:
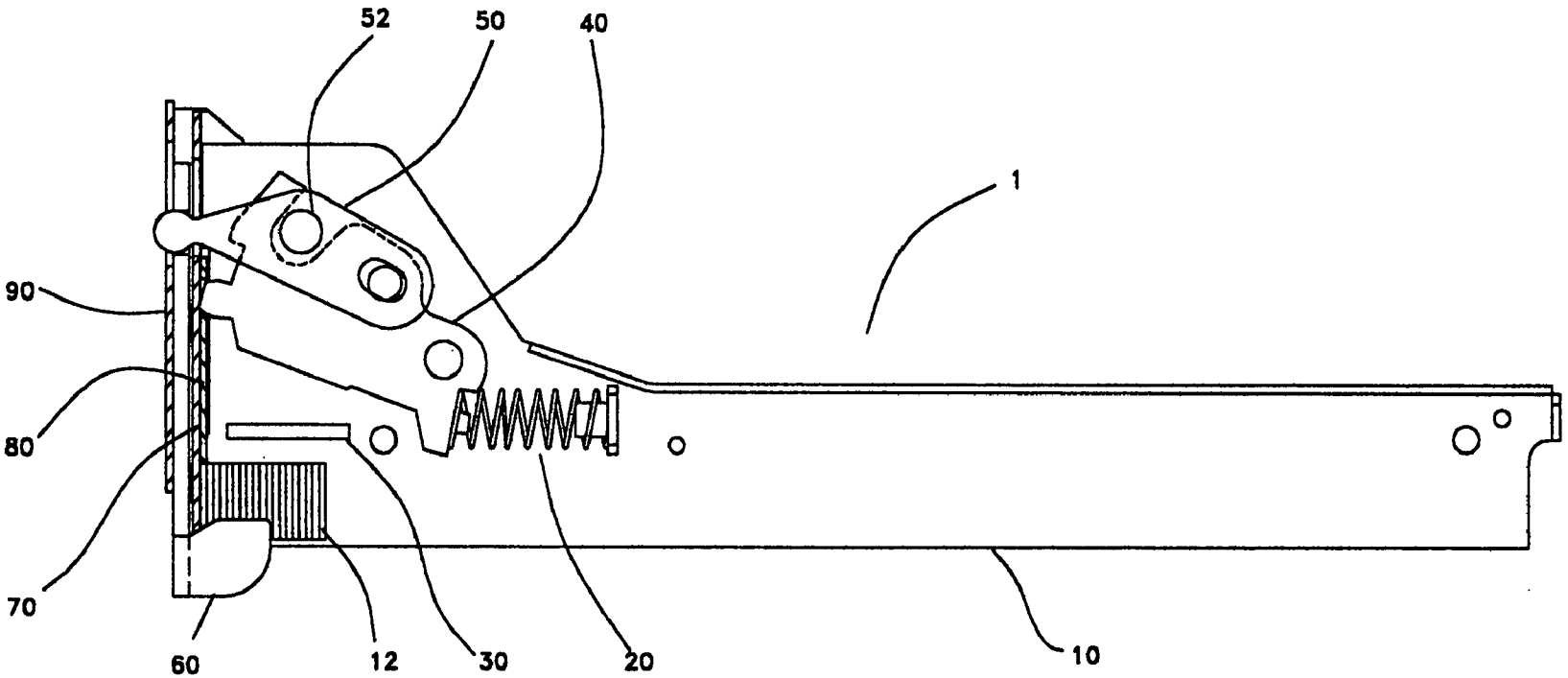
Fig. 1 Prior Art
FIG. 1 is a cross-sectional elevation view of a typical slaphammer, a type of manually actuated fastener driver, with a portion of the device housing removed.

The present invention relates to a manually actuated fastener driver device having a reservoir of fasteners and fastener caps, and a cap advancement mechanism that delivers a fastener cap with each fastener upon actuation of the device.

In one aspect, the invention relates to a manually actuated fastener driver device comprising a fastener driver frame having a reservoir of fasteners that feed into position beneath a driver operated by a driver lever that is actuated via a force applied manually by a user; a fastener cap reservoir disposed in proximity to the driver of the device and configured to contain a supply of fastener caps arranged in a cap strip having a connection between individual caps that is breakable upon actuation of the device and delivery of an individual cap; a cap track providing guidance for the cap strip from the reservoir to a position proximal to a fastener delivery position such that a fastener can be delivered through an individual cap upon actuation of the device; and a cap advancement mechanism configured to advance the cap strip one cap position upon each actuation of the device, wherein the cap advancement mechanism is driven by manual actuation of the device.

In one embodiment, the manually actuated fastener driver device further comprises a striker lever having a first end configured to contact and transfer force to the driver lever, a intermediate fixed pivotal attachment point to the device frame, and a second end configured to contact the cap advance mechanism; and a striker having a lower end which contacts a work surface when the user strikes the work surface with the device, and an upper end contacting a position of the striker lever at a contact point such that the pivotal attachment point is between the contact point and the first end of the striker lever.

In another embodiment, the manually actuated fastener driver device further comprises a cap advance slider, where the second end of the striker lever contacts the cap advance slider upon actuation of the device; a cap advance slider guide, in which the cap advance slider travels upward during a device actuation cycle; and a cap advance spring attached at a first end to the cap advance slider and at second end to a fixed attachment point on the device frame. The cap advance spring urges the cap advance slider downward toward a pre-actuation position.

In another embodiment, the manually actuated fastener driver device further comprises a cap pusher pivotally connected to the cap advance slider; and a cap pusher spring positioned between the cap advance slider and the cap pusher, urging the cap pusher toward the cap strip. The cap pusher contacts the cap strip to advance the cap strip upon actuation.

The driver lever can be actuated when a user strikes a work surface with the striker. The striker can be configured to transfer force to the striker lever which has a first end that contacts and transfers a portion of the striking force to the driver lever when a work surface is struck with the striker, the first end of the driver lever concurrently transferring operating force to the driver which drives a fastener into the work surface. The second end of the striker lever can contact the cap advance slider and move it upward in the cap advance slider guide.

The driver lever can be in contact with a return spring at one end such that the return spring is compressed upon actuation of the device, thereby providing a force urging the driver lever and the striker lever into a pre-actuation position.

In another embodiment, the cap advance slider further comprises at least one delay catch which engages with a ledge in the cap advance slider guide when the cap advance slider is moved upward by the second end of the striker lever and is disengaged from the ledge by the downward motion of the second end of the striker lever as the striker lever is urged to a pre-actuation position by the return spring. The cap advance slider can be pivotally attached to a cap pusher that contacts the cap strip and advances the cap strip one cap position upon each actuation of the device, thereby advancing a subsequent individual cap into position beneath a subsequent fastener.

In another embodiment, the manually actuated fastener driver device further comprises a cap strip cutter which severs or breaks a connection between two adjacent caps in the cap strip, when the cap strip is pushed upward by the lower of the striker upon actuation of the device.

The fastener driver frame can comprise an elongated portion extending from a first end comprising a driver to an opposite end comprising a user handle, wherein the elongated portion including the handle comprises a fastener reservoir. The driver can be a driver blade configured to drive staple-type fasteners.

In another aspect, the invention relates to a manually actuated fastener driver device comprising: a fastener driver frame having a reservoir of fasteners that feed into position beneath a driver operated by a driver lever that is actuated via contact with a first end of a striker lever, the striker lever receiving a force from a striker past an intermediate fixed pivotal attachment point, wherein the force is provided by contact with a work surface when a user strikes the work surface with the striker of the device; a fastener cap reservoir disposed in proximity to the driver of the device and configured to contain a supply of fastener caps arranged in a cap strip, and where the cap strip includes a connection between individual caps in the strip that is breakable upon actuation of the device and delivery of a cap and fastener; a cap track providing guidance for the cap strip from the reservoir to a position in proximity to a location beneath a fastener and such that a fastener is delivered through an individual cap upon actuation of the device; and a cap advancement mechanism configured to advance the cap strip one cap position upon each actuation of the device. The cap advancement mechanism can comprise a cap advance slider in a cap advance slider guide, contacted by a second end of the striker lever configured to contact a cap advance slider striker lever catch; a cap advance slider spring, attached to the cap advance slider and a fixed point on the fastener driver frame; a cap pusher pivotally connected to the cap advance slider that contacts the cap strip to advance the cap strip upon actuation of the device. The cap advance slider can be advanced in the cap advance slider guide against the force of a cap advance slider return spring by contact with a second end of the striker lever configured to contact a cap advance slider upon actuation, and the cap pusher can advance the cap strip as the cap advance slider is returned to a pre-actuation position under force of the cap advance slider return spring.

In one embodiment, the cap advance slider further comprises at least one delay catch which engages with a ledge in the cap advance slider guide when the cap advance slider is moved upward by the second end of the striker lever and is disengaged from the ledge by the downward motion of the second end of the striker lever as the striker lever is urged to a pre-actuation position by the cap advance slider return spring, such that the cap pusher contacts the cap strip and advances the cap strip one cap position upon each actuation of the device, thereby advancing a subsequent individual cap into position beneath a subsequent fastener. The fastener cap reservoir can be configured to hold a rolled cap strip. The fastener cap reservoir can be positioned proximal to the driver and substantially on a side of the device opposite a position where fasteners and fastener caps are delivered to a work surface. The fastener cap reservoir can comprise a latched opening on the side of the reservoir that is adapted to allow loading of a rolled cap strip.

In another embodiment, the manually actuated fastener driver device further comprises a cap hook positioned adjacent to the cap strip at a position between the cap pusher and a fastener delivery position. The cap hook can comprise a fixed pivotal attachment to the device frame; at least one cap strip contact projection; and an attachment point for a cap hook spring. The cap hook spring can be attached at one end to the cap hook at the attachment point and at the other end to a fixed attachment point on the device frame, such that the at least one cap strip contact projection is urged in the direction of the cap strip via force applied to the cap hook by the cap spring, thereby contacting the cap strip in a manner that tends to prevent backward motion of the cap strip after the cap strip is advanced by actuation of the device.

With reference to the drawings and generally in the description of the invention herein, the term "upward" means generally away from a position of fastener delivery to a work surface acted on by the device during use. The term "downward" means generally toward the point of fastener delivery.

As shown in FIG. 1, a typical slaphammer 1 (a type of manually actuated fastener driver, operating using the force of striking against a work surface) can comprise elongated frame assembly 10, including a means for fastener storage and delivery as well as an external grip means associated with the portion of the frame distal to the driver assembly. Return spring 20 supplies a force which returns the driver assemblage to a pre-actuation position via driver lever 40. Driver lever 40 pivots about a point proximal to one end of return spring 20, such that return spring 20 is compressed upon actuation. The end of driver lever 40 that is distal to return spring 20 travels downward toward the work surface in conjunction with driver blade 80 upon actuation. Driver lever 40 may extend through a slot in driver blade 80, such that the parts are articulated in an operable manner, whereby a downward force (toward a work surface) and upward force (away from a work surface) can be transferred from drive lever 40 to driver blade 80 (adjacent to inner cover 70). The downward motion of driver lever 40 is limited by bumper assembly 30 in some embodiments. The force generating the downward motion of driver lever 40 and driver blade 80 is applied through striker lever 50, which has an first end proximal to and contacting driver lever 40; a central, stationary pivotal attachment point 52; and a second end contacting a top portion of striker 60, which transfers the upward force of the actuation contact with the work surface to driver lever 40. Striker lever 50 may be articulated with striker 60 by extending through a slot in the upper portion of striker 60. The end of striker 60 that is distal from striker lever 50 is positioned to make contact with a work surface when the slaphammer 1 is struck against the work surface by a user, in a manner similar to the action performed when using a conventional hammer.

Figure 2:
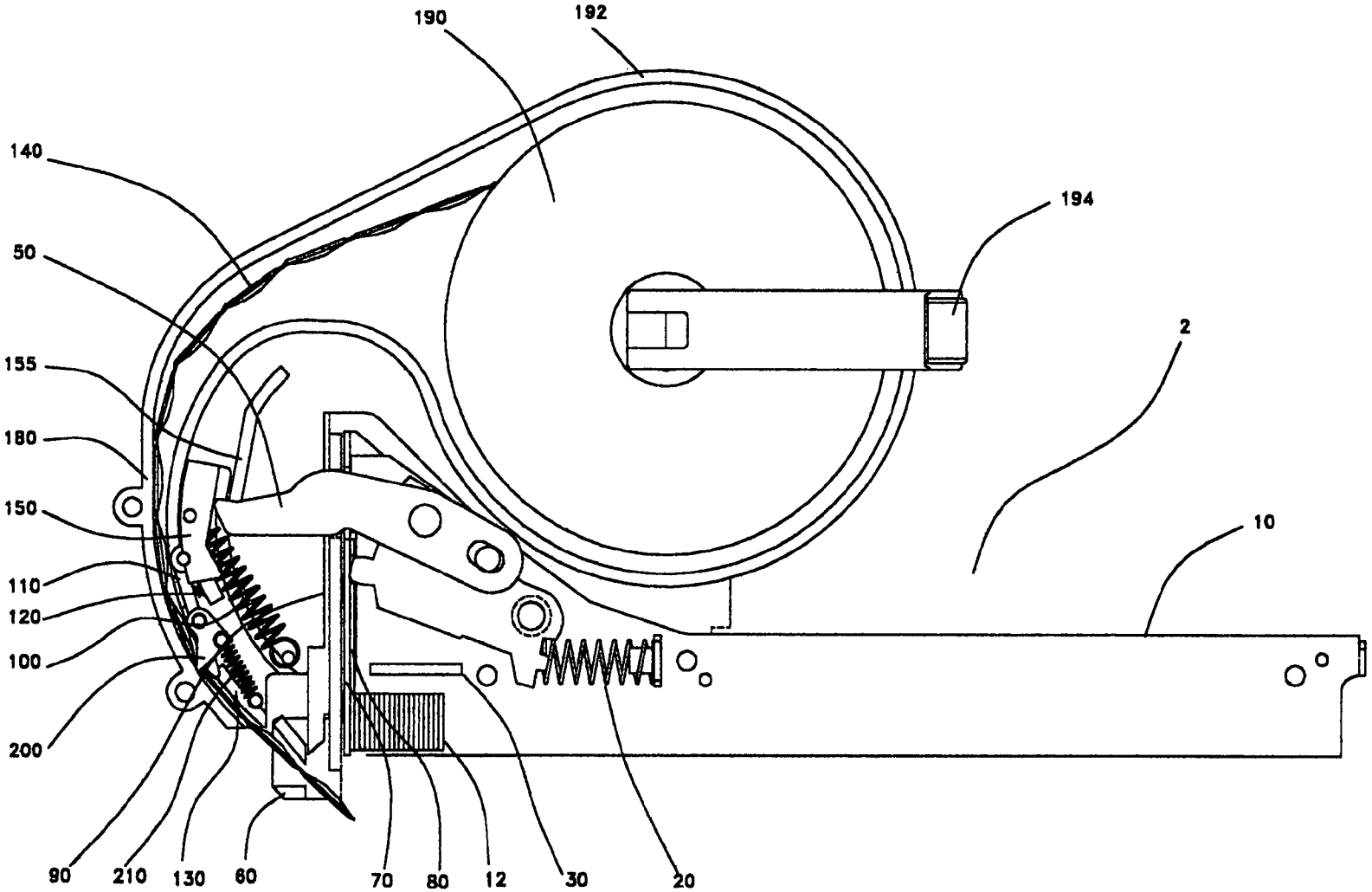
FIG. 2 is an elevation view of one embodiment of the invention, with a portion of the device housing removed.

FIG. 2 shows one embodiment 2 of the present invention, which comprises a number of parts and features common to the slaphammer illustrated in FIG. 1. However, a number of components have been modified or added to accomplish automated feeding, positioning, and delivery of fastener caps such that a fastener is driven through a single cap which is applied to the work surface along with the fastener by actuation of the device. Fasteners 12 are shown in a fastener reservoir within the frame 10 of the device 2 (as would also be the situation in the device 1 depicted in FIG. 1).

Striker lever 50 is extended past outer cover 90 as shown in FIG. 1 (outer cover with cap strip cutter 90, as shown in FIG. 2). The extension of striker lever 50 allows a second end of striker lever 50 to contact and actuate the cap advance mechanism. More specifically, the second end of striker lever 50 that is distal to the articulation with driver lever 40 is configured to contact cap advance slider 150. Cap advance slider 150 is connected to cap advance spring 100, which is attached at the opposite end to a stationary attachment point on the device frame. Cap advance slider 150 also is pivotally attached to cap pusher 110, which contacts cap strip 140 in cap track 180. Following actuation, cap pusher 110 urges cap strip 140 downward, thereby advancing cap strip 140 one cap position. Cap strip 140 is prevented from moving upward after advancement by cap hook 200. Cap strip 140 is further guided by cap holder plate 130 below cap hook 200.

Cap strip 140 is fed into cap track 180 from cap spool 190, which is rotatably positioned within cap reservoir 192. Cap reservoir 192 can be opened from the side in particular embodiments via side door latch 194, which allows unloading and loading of cap spool 190.

Figure 3:
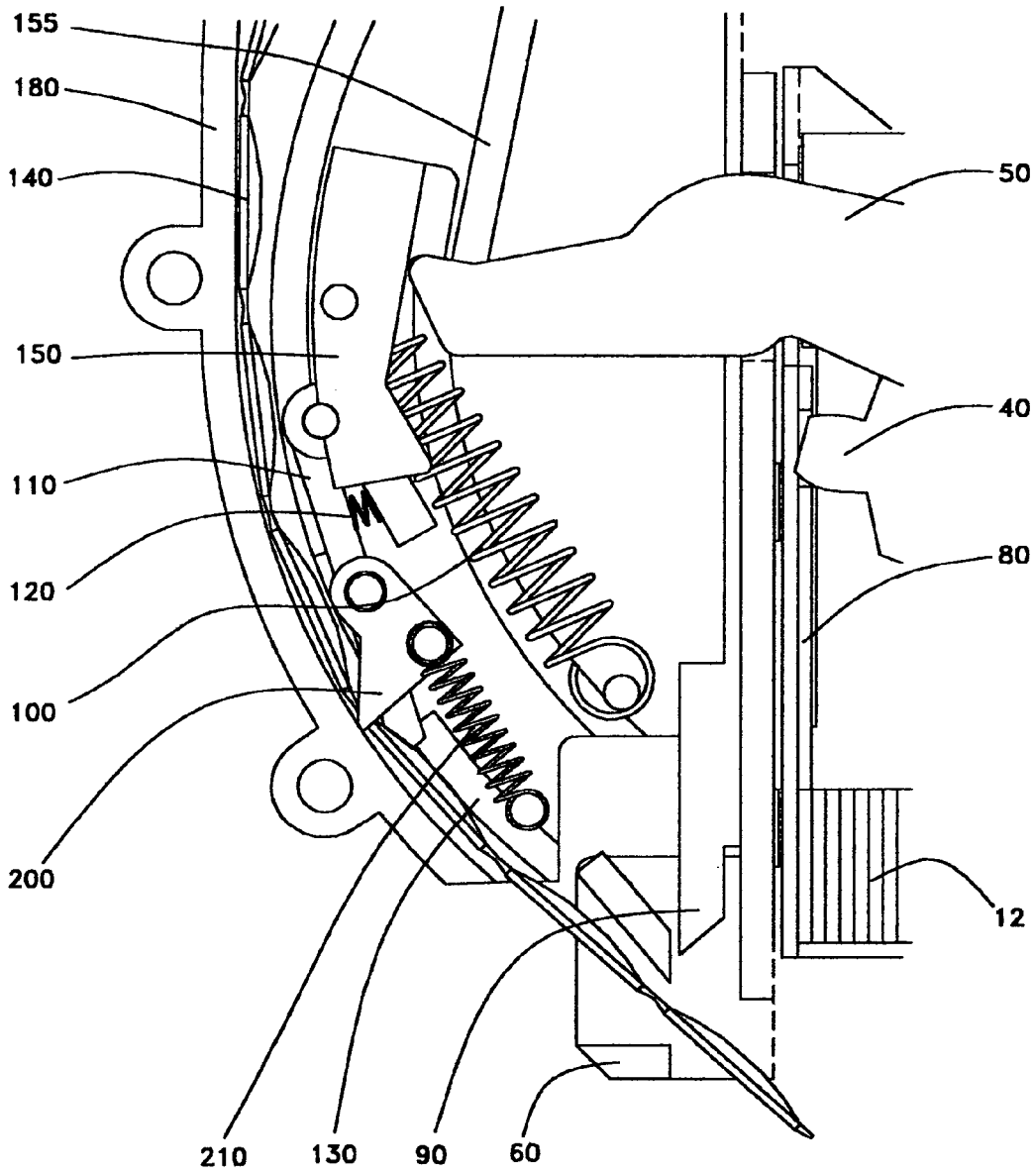
FIG. 3 is a detailed cross-sectional elevation view of one embodiment of the invention showing the arrangement of components prior to actuation.
Figure 4:
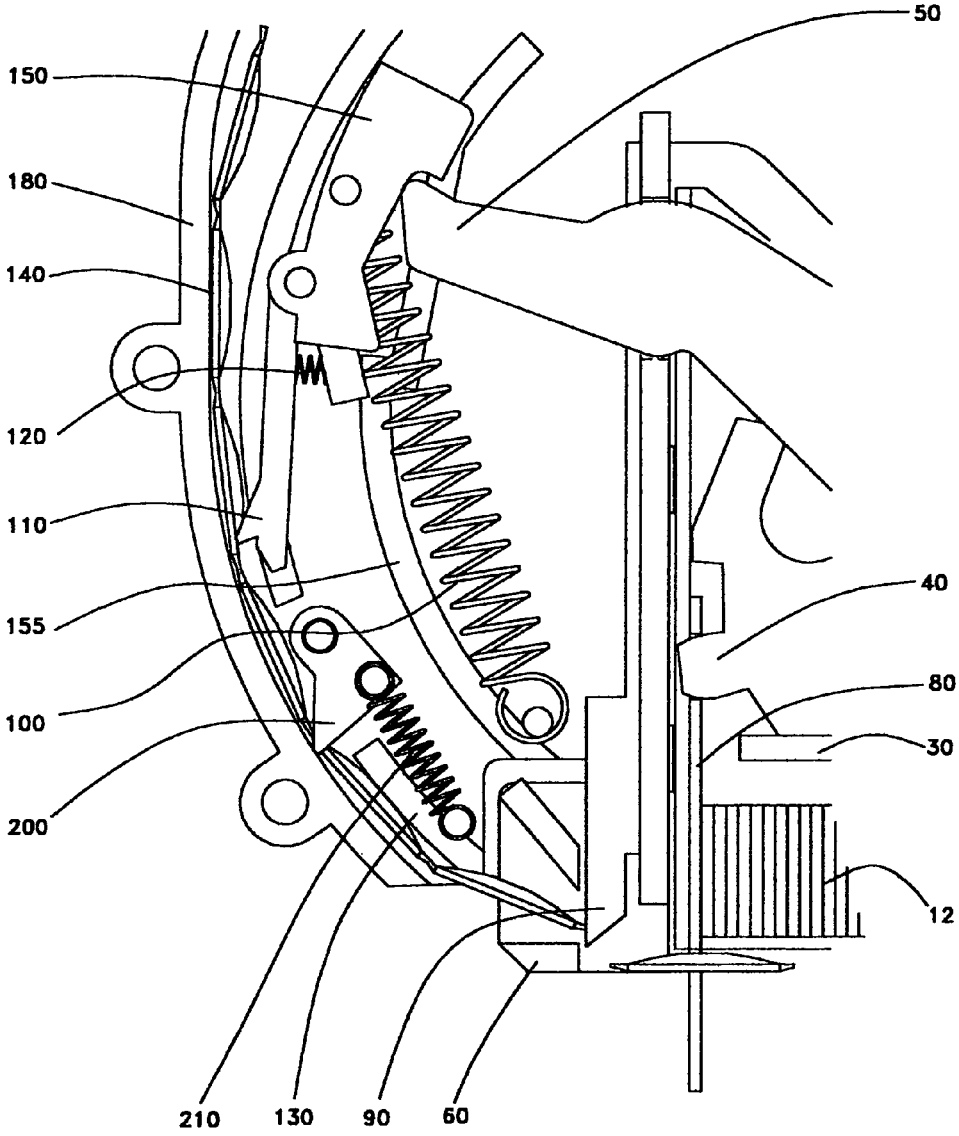
FIG. 4 is a cross-sectional elevation view of an embodiment of the invention as in FIG. 3, but showing the arrangement of components upon actuation by striking a work surface (e.g., to which a sheet-like material is applied using fasteners and caps).

FIG. 3 shows a detailed elevational view of the device 2 prior to actuation (At Rest). FIG. 4 shows a detailed elevational view of the device 2 during actuation, upon striking a work surface (Full Stroke). After actuation, components of the device 2 return to their positions as shown in FIG. 3, performing the functions as indicated above during actuation and during return to pre-actuation positions. The operation of the device 2 upon actuation is discussed in greater detail below, with regard to FIGS. 3 and 4.

Prior to actuation, a single terminal cap of cap strip 140 is positioned between a fastener delivered from a fastener reservoir via an independent, conventional advancing means disposed in the extended handle portion of the frame assembly. Upon actuation, striker lever 50 pushes cap advance slider 150 upward via its contact with striker lever projection 156 (see FIG. 5). During actuation, when cap advance slider 150 is in an upward position, catch projection 158 engages a ledge in the device frame such that the downward motion of striker lever 50, following actuation, is required to disengage catch projection 158 and allow cap advance slider 150 to move downward. As cap advance slider 150 moves downward, cap pusher 110 contacts cap strip 140 and urges it downward one cap position such that a cap is positioned beneath the next fastener in preparation of a subsequent actuation. Cap pusher 110 is urged against cap strip 140 by cap pusher spring 120. Cap strip 140 is prevented from moving upward by cap hook 200, which is urged against cap strip 140 by cap hook spring 210.

During actuation, the lower portion of striker 60 carries cap strip 140 upward into contact with cap strip cutter 90. Cutter 90 severs an attachment member or members positioned between individual caps of cap strip 140 and allows the delivery of a single cap with a single fastener passing through the cap upon actuation of the device. Caps in cap strip 140 are delivered from cap reservoir housing 192 via cap spool 190 which is positioned proximal to the end of the device which delivers caps and fasteners, but is generally positioned on a side of the device opposite the work surface being struck during actuation.

Figure 5:
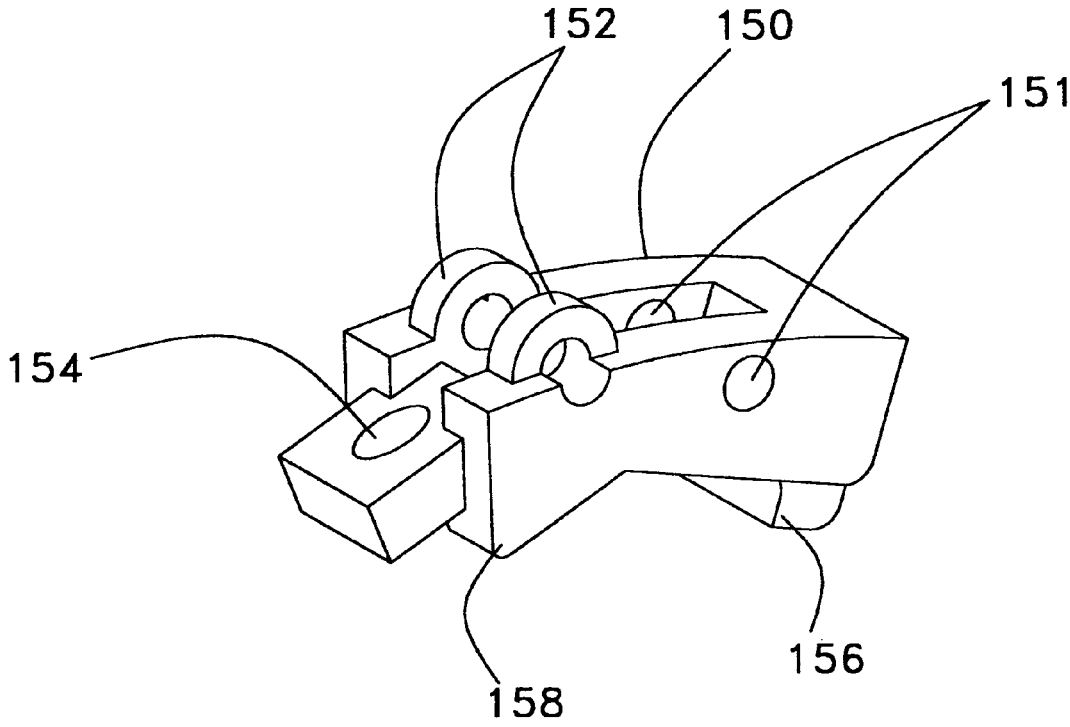
FIG. 5 is a perspective view of the cap advance slider according to one embodiment of the invention.

FIG. 5 is a perspective view of cap advance slider 150 from the side of attachment of cap pusher 110. Attachment pin apertures 151 in cap advance slider 150 are configured to hold a pin for attaching one end of cap advance spring 100, which attaches within a cut out portion located centrally within cap advance slider 150 via a pin. Also shown are attachment pin brackets 152, which are configured to hold a pin for pivotal attachment of cap pusher 110. Recess 154 receives one end of cap pusher spring 120. The other end of cap pusher spring 120 is received in recess 114 of cap pusher 110 (see FIG. 6B; as well as FIGS. 3 and 4).

FIG. 5 also shows striker lever catch 156, which is contacted by striker lever 50 upon actuation of the device 2, and by which cap advance slider 150 is carried upward by striker lever 50. Delay catch 158 contacts a ledge on cap advance slider guide 155 (see FIG. 4). As striker lever 50 returns to a pre-actuation position, urged by return spring 20, acting through driver lever 40, striker lever 50 dislodges delay catch 158 from the ledge in cap advance slider guide 155, thereby allowing cap advance slider 150 to move downward to a pre-actuation position. This arrangement produces a slight delay in operation of the cap advancement mechanism, helping to ensure that the fastener and cap are fully delivered prior to advancement of cap strip 140 to position the next cap beneath the next fastener in preparation for a subsequent actuation.

Figure 6A:
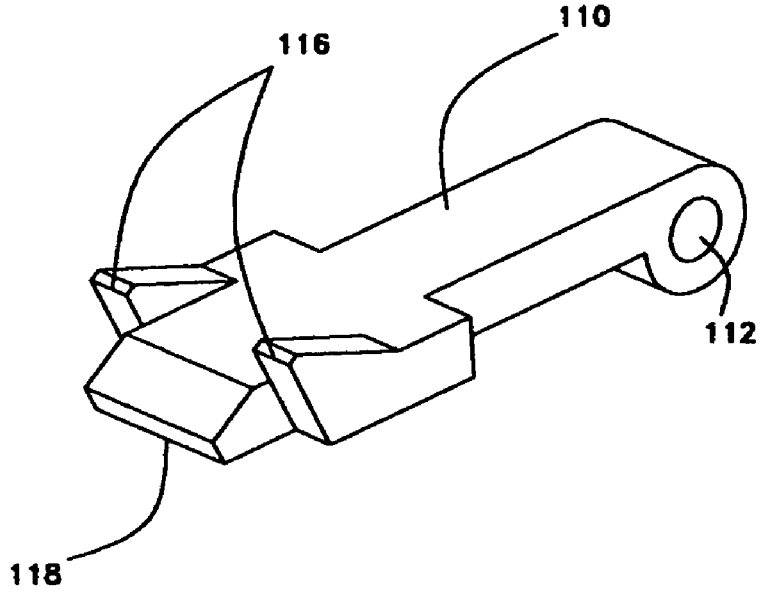
FIGS. 6A and 6B are perspective views of the cap pusher of one embodiment of the invention, showing the cap strip-contacting surface and the cap advance slider-contacting surface, respectively.
Figure 6B:
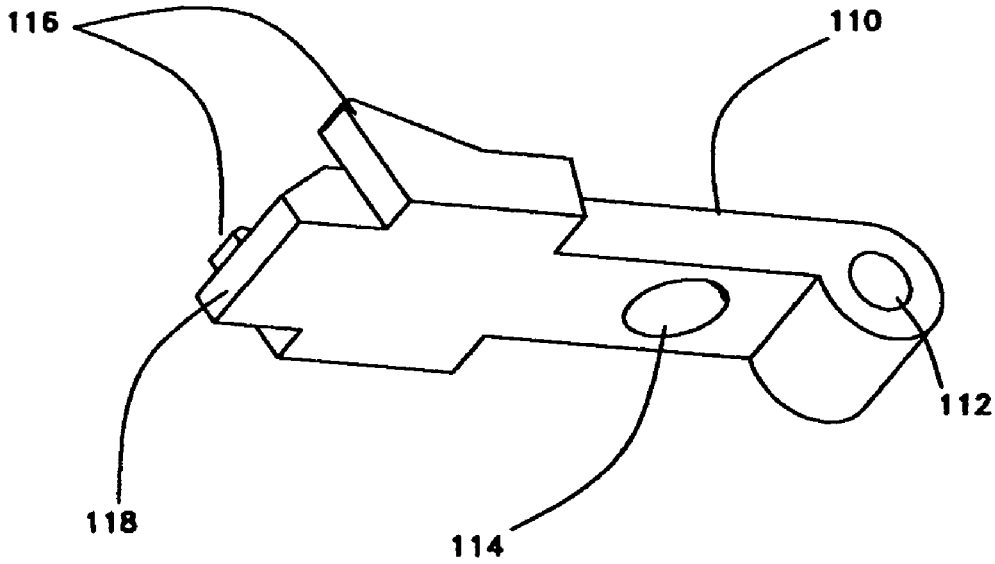

FIG. 6A is a perspective view of cap pusher 110 from the side of cap pusher 110 that contacts cap strip 140. Pin aperture 112 is adapted to receive a pin allowing pivotal attachment of cap pusher 110 to cap advance slider 150 via attachment pin brackets 152. Cap-edge contact projections 116 allow cap pusher 110 to firmly contact an edge portion of a cap within cap strip 140 upon actuation of the device 2, and to exert a downward force against the cap edge, thereby urging cap strip 140 downward one cap position each time the device 2 returns to a pre-actuation position. Cap contact tab 118 aids in positioning cap pusher 110 and cap-edge contact projections 116 against a cap of cap strip 140. FIG. 6B shows cap pusher spring recess 114, which receives one end of cap pusher spring 210.

Figure 7:
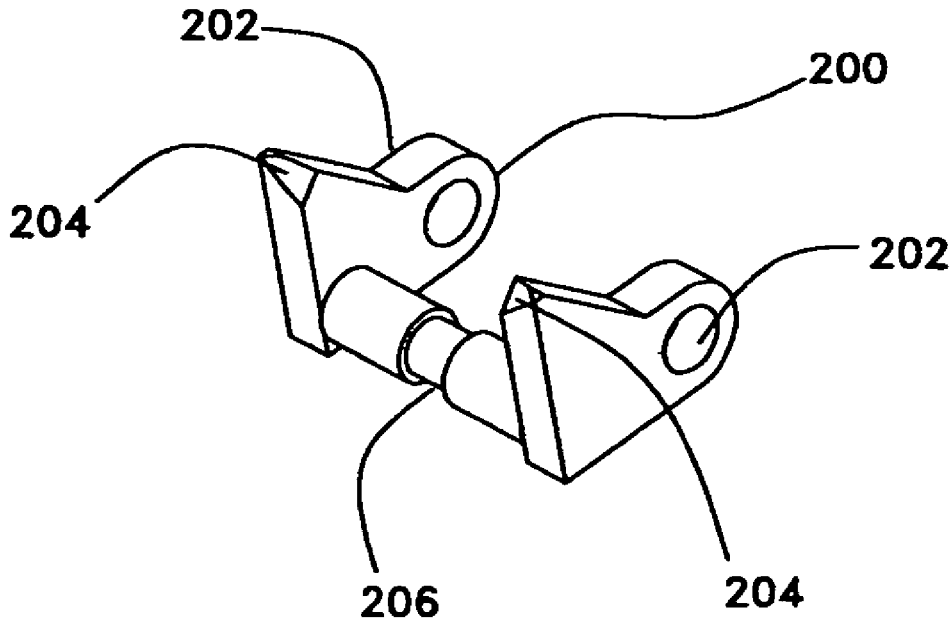
FIG. 7 is a perspective view of the cap hook according to one embodiment of the invention, as viewed from the cap strip-contacting side of the cap hook.
Figure 8:
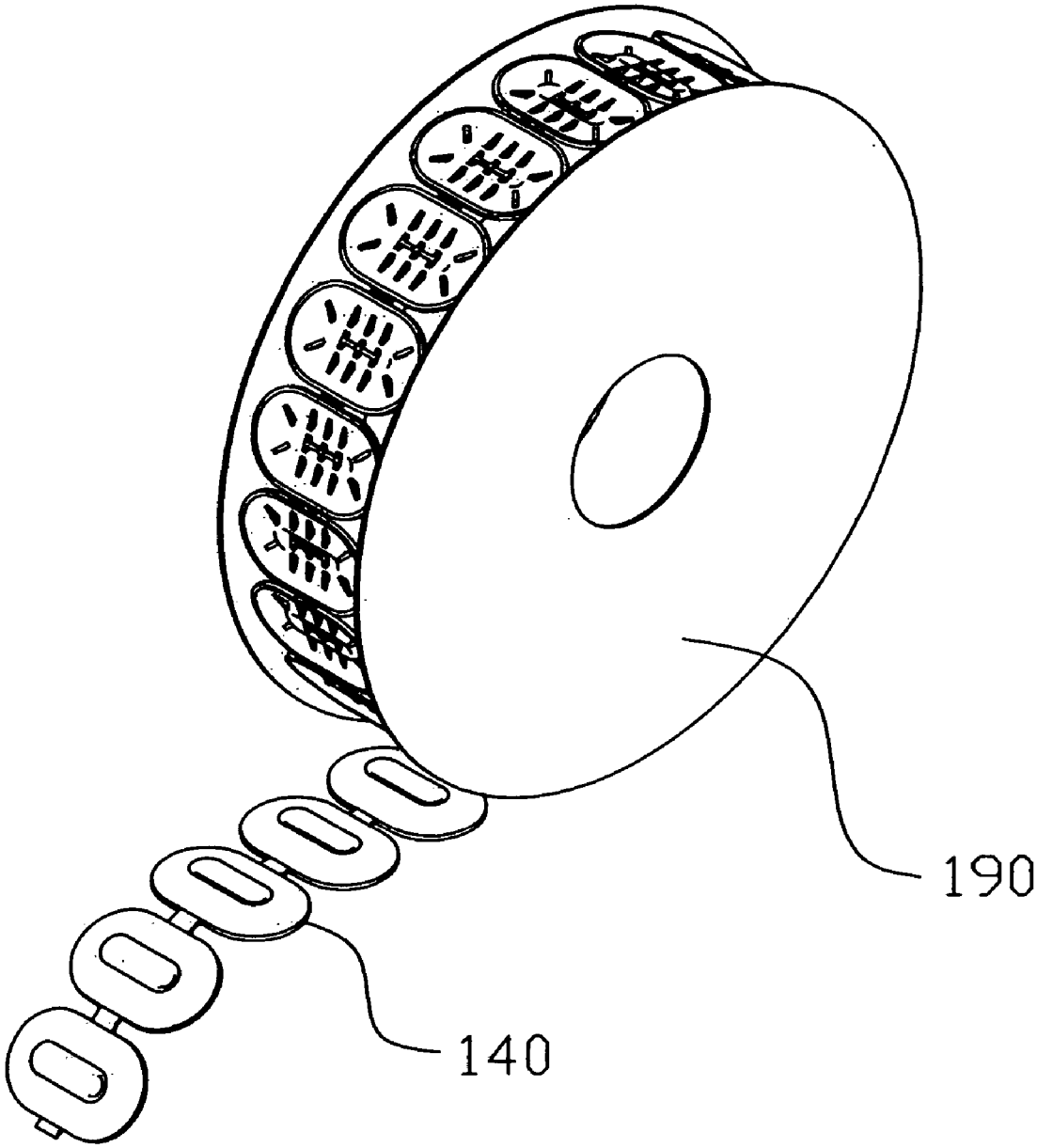
FIG. 8 is a perspective view of one embodiment of a cap strip of the invention, showing connections between caps and a cap strip roll as can be used in the cap reservoir of one embodiment the invention.

FIG. 7 shows a perspective view of cap hook 200 from the side of cap hook 200 that contacts cap strip 140. Pin apertures 202 are configured to allow pivotal attachment of cap hook 200 to a stationary attachment point on the device frame. Cap strip contact projections 204 also are shown. Cap hook spring attachment recess 206 is shown as the circumferential notch around the cylindrical cross member connecting the two sides of cap hook 200. Cap hook spring 210 attaches in recess 206 and urges cap strip contact projections 204 toward cap strip 140.

Further details regarding possible arrangements of standard hammer-type fastener drivers are disclosed in U.S. Pat. No. 2,896,210 to Rubin; U.S. Pat. No. 6,012,623 to Fealey and U.S. Pat. Nos. 5,975,401; and 6,802,443 to Lu, all incorporated herein by reference in their entirety. Information regarding rollable cap strips is provided in U.S. Pat. Nos. 6,145,725 and 5,947,362 to Omli; as well as in U.S. Pat. No. 6,779,700 to Bruins, et al., all incorporated herein by reference in their entirety. In particularly preferred embodiments, the cap strips used are those prepared by B-Kap Enterprises, Inc. (Rural Hall, N.C.).

Materials used in the construction of the frame and various parts in particular embodiments of the present invention generally include steel, aluminum, and other metal alloys. Plastics, including reinforced plastics such as glass-filled plastic, and other non-metal materials can also be used to provide particular features as appropriate and as would be recognized by one of ordinary skill in the art.

While this invention has been illustrated and described in accordance with preferred embodiments, it is recognized that variations and changes may be made therein without departing from the invention as set forth in the claims. Certain modifications and improvements will occur to those skilled in the art upon a reading of the forgoing description. It should be understood that all such modifications are not contained herein for the sake of conciseness and readability, but are properly within the scope of the following claims.

What is claimed is:

1. A manually actuated fastener driver device comprising:

a) a fastener driver frame having a reservoir of fasteners that feed into position beneath a driver operated by a driver lever that is actuated via a force applied manually by a user;

b) a fastener cap reservoir disposed in proximity to the driver of the manually actuated fastener driver device and configured to contain a supply of fastener caps arranged in a cap strip having a connection between individual caps that is breakable upon actuation of the manually actuated fastener driver device and delivery of an individual cap;

c) a cap track providing guidance for the cap strip from the reservoir to a position proximal to a fastener delivery position such that a fastener can be delivered through an individual cap upon actuation of the manually actuated fastener driver device;

d) a cap advancement mechanism configured to advance the cap strip one cap position upon each actuation of the manually actuated fastener driver device, e) a striker lever having a first end configured to contact and transfer force to the driver lever, a intermediate fixed pivotal attachment point to the manually actuated fastener driver device frame, and a second end configured to contact the cap advance mechanism; and f) a striker having a lower end which contacts a work surface when the user strikes the work surface with the manually actuated fastener driver device, and an upper end contacting a position of the striker lever at a contact point such that the pivotal attachment point is between the contact point and the first end of the striker lever, wherein the cap advancement mechanism is driven by manual actuation of the manually actuated fastener driver device.

2. The manually actuated fastener driver device of claim 1, further comprising a) a cap advance slider, where the second end of the striker lever contacts the cap advance slider upon actuation of the manually actuated fastener driver device;

b) a cap advance slider guide, in which the cap advance slider travels upward during a manually actuated fastener driver device actuation cycle; and c) a cap advance spring attached at a first end to the cap advance slider and at second end to a fixed attachment point on the manually actuated fastener driver device frame, wherein the cap advance spring urges the cap advance slider downward toward a pre-actuation position.

3. The manually actuated fastener driver device of claim 2, further comprising a) a cap pusher pivotally connected to the cap advance slider; and b) a cap pusher spring positioned between the cap advance slider and the cap pusher, urging the cap pusher toward the cap strip, wherein the cap pusher contacts the cap strip to advance the cap strip upon actuation.

4. The manually actuated fastener driver device of claim 2, wherein the driver lever is actuated when a user strikes a work surface with the striker, the striker being configured to transfer force to the striker lever which has a first end that contacts and transfers a portion of the striking force to the driver lever when a work surface is struck with the striker, the first end of the driver lever concurrently transferring operating force to the driver which drives a fastener into the work surface, and the a second end of the striker lever contacting the cap advance slider and moving it upward in the cap advance slider guide.

5. The manually actuated fastener driver device of claim 4, wherein the driver lever is in contact with a return spring at one end such that the return spring is compressed upon actuation of the manually actuated fastener driver device, thereby providing a force urging the driver lever and the striker lever into a pre-actuation position.

6. The manually actuated fastener driver device of claim 5, wherein the cap advance slider further comprises at least one delay catch which engages with a ledge in the cap advance slider guide when the cap advance slider is moved upward by the second end of the striker lever and is disengaged from the ledge by the downward motion of the second end of the striker lever as the striker lever is urged to a pre-actuation position by the return spring, such that a cap pusher contacts the cap strip and advances the cap strip one cap position upon each actuation of the manually actuated fastener driver device, thereby advancing a subsequent individual cap into position beneath a subsequent fastener.

7. The manually actuated fastener driver device of claim 2, wherein the cap advance slider comprises a delay catch that contacts a ledge on a cap advance slider guide upon actuation such that return of the cap advance slider to a pre-actuation position is accomplished by return of the striker lever which dislodges the delay catch from the ledge.

8. The manually actuated fastener driver device of claim 1, further comprises a cap strip cutter which severs or breaks a connection between two adjacent caps in the cap strip, when the cap strip is pushed upward by the lower of the striker upon actuation of the manually actuated fastener driver device.

9. The manually actuated fastener driver device of claim 1, wherein the fastener driver frame comprises an elongated portion extending from a first end comprising a driver to an opposite end comprising a user handle, wherein the elongated portion including the handle comprises a fastener reservoir.

10. The manually actuated fastener driver device of claim 1, wherein the driver is a driver blade configured to drive staple-type fasteners.

11. A manually actuated fastener driver device comprising:

a) a fastener driver frame having a reservoir of fasteners that feed into position beneath a driver operated by a driver lever that is actuated via contact with a first end of a striker lever, the striker lever receiving a force from a striker past some distance from an intermediate fixed pivotal attachment point of the striker lever, wherein the force is provided by contact with a work surface when a user strikes the work surface with the striker of the manually actuated fastener driver device;

b) a fastener cap reservoir disposed in proximity to the driver of the manually actuated fastener driver device and configured to contain a supply of fastener caps arranged in a cap strip, and where the cap strip includes a connection between individual caps in the strip that is breakable upon actuation of the manually actuated fastener driver device and delivery of a cap and fastener;

c) a cap track providing guidance for the cap strip from the reservoir to a position in proximity to a location beneath a fastener and such that a fastener is delivered through an individual cap upon actuation of the manually actuated fastener driver device; and d) a cap advancement mechanism configured to advance the cap strip one cap position upon each actuation of the manually actuated fastener driver device, the cap advancement mechanism comprising i) a cap advance slider in a cap advance slider guide, contacted by a second end of the striker lever configured to contact a cap advance slider striker lever catch;

ii) a cap advance slider spring, attached to the cap advance slider and a fixed point on the fastener driver frame;

iii) a cap pusher pivotally connected to the cap advance slider that contacts the cap strip to advance the cap strip upon actuation of the manually actuated fastener driver device; wherein the cap advance slider is advanced in the cap advance slider guide against the force of a cap advance slider return spring by contact with a second end of the striker lever configured to contact a cap advance slider upon actuation, and where the cap pusher advances the cap strip as the cap advance slider is returned to a pre-actuation position under force of the cap advance slider return spring.

12. The manually actuated fastener driver device of claim 11, wherein the cap advance slider further comprises at least one delay catch which engages with a ledge in the cap advance slider guide when the cap advance slider is moved upward by the second end of the striker lever and is disengaged from the ledge by the downward motion of the second end of the striker lever as the striker lever is urged to a pre-actuation position by the cap advance slider return spring, such that the cap pusher contacts the cap strip and advances the cap strip one cap position upon each actuation of the manually actuated fastener driver device, thereby advancing a subsequent individual cap into position beneath a subsequent fastener.

13. The manually actuated fastener driver device of claim 11, wherein the fastener cap reservoir is configured to hold a rolled cap strip.

14. The manually actuated fastener driver device of claim 13, wherein the fastener cap reservoir comprises a latched opening on the side of the reservoir that is adapted to allow loading of a rolled cap strip.

15. The manually actuated fastener driver device of claim 11, wherein the fastener cap reservoir is positioned proximal to the driver and substantially on a side of the manually actuated fastener driver device opposite a position where fasteners and fastener caps are delivered to a work surface.

16. The manually actuated fastener driver device of claim 11, further comprising a cap hook positioned adjacent to the cap strip at a position between the cap pusher and a fastener delivery position, the cap hook comprising a) a fixed pivotal attachment to the manually actuated fastener driver device frame;

b) at least one cap strip contact projection; and c) an attachment point for a cap hook spring, wherein the cap hook spring is attached at one end to the cap hook at the attachment point and at the other end to a fixed attachment point on the manually actuated fastener driver device frame, such that the at least one cap strip contact projection is urged in the direction of the cap strip via force applied to the cap hook by the cap spring, thereby contacting the cap strip in a manner that tends to prevent backward motion of the cap strip after the cap strip is advanced by actuation of the manually actuated fastener driver device.

* * * * *